US005277607A

United States Patent [19]

Thumma et al.

[11] Patent Number: 5,277,607

[45] Date of Patent: Jan. 11, 1994

[54] ELECTRICAL CONNECTOR WITH SHORTING CONTACTS WHICH WIPE AGAINST EACH OTHER

[75] Inventors: Mark R. Thumma, Oberlin, Pa.; Charles S. Pickles, North Attleboro, Mass.

[73] Assignee: The Whitaker Corporation, Wilmington, Del.

[21] Appl. No.: 6,069

[22] Filed: Jan. 15, 1993

[51] Int. Cl.[5] ..... H01R 23/68

[52] U.S. Cl. ..... 439/188; 439/637

[58] Field of Search ..... 439/188, 513, 59, 60, 439/62, 629, 630, 636, 637; 200/51.09, 51.1

[56] References Cited

U.S. PATENT DOCUMENTS

| | | | |
|---|---|---|---|
| 3,627,929 | 12/1971 | Gilissen et al. | 439/188 |
| 3,976,850 | 8/1976 | Faber et al. | 200/51.1 |
| 4,087,151 | 5/1978 | Robert et al. | 439/188 |
| 4,106,841 | 8/1978 | Vladic | 439/188 |
| 4,285,565 | 8/1981 | Kirby | 439/637 |
| 4,514,030 | 4/1985 | Triner et al. | 439/188 |
| 4,647,140 | 3/1987 | Crawford | 439/629 |
| 5,098,306 | 3/1992 | Noschese et al. | 439/188 |

FOREIGN PATENT DOCUMENTS

| | | |
|---|---|---|
| 2802800 | 1/1978 | Fed. Rep. of Germany . |
| 8504528 | 10/1985 | PCT Int'l Appl. . |
| 2133938 | 8/1984 | United Kingdom . |

*Primary Examiner*—Gary F. Paumen
*Attorney, Agent, or Firm*—William B. Noll

[57] ABSTRACT

A pair of shorting contacts (16,16) on mated connector bodies (10,10). The shorting contacts are protrusions on the respective connector bodies which are laterally reversed mirror images of each other. The respective protrusions confront each other in a substantially transverse configuration. Initial engagement between the respective protrusions is at an initial point contact (25) at a high stress. The protrusions thereafter wipe against one another and come to engage at a final point contact (26). The path from the initial point contact to the final point contact constitutes a line between the respective connector bodies.

11 Claims, 11 Drawing Sheets

ELECTRICAL CONNECTOR WITH SHORTING CONTACTS WHICH WIPE AGAINST EACH OTHER

The present invention relates to shorting contacts for a printed circuit board assembly and more particularly to contacts which wipe against one another and engage one another at a final point contact.

BACKGROUND OF THE INVENTION

A mother board and one or more daughter boards are used to transfer signals between respective assemblies used in a computer or other electronic equipment. The mother and daughter boards may be arranged perpendicular to each other, as in an "edge card" configuration, depending upon the design of the overall product.

Edge card connector contacts are formed on the mother card so that when the daughter card is removed, the opposing contacts come together to form an electrical shorting circuit. The reliability of these shorting contacts is very important to the efficiency of the overall equipment. Due to the environment in which the boards are located, there is the possibility of debris being collected at the interface between the mother board and the daughter board or of a film being formed on the opposing contacts on the mother card. In this type of situation, the electrical connection between the opposing contacts may be imperfect or unreliable and may result in malfunction of the electronic equipment.

The following citations reflect the state of the art of which the applicant is aware insofar as these citations appear relevant to the present invention.

| U.S. Pat. No. | Inventor(s) | Issue Date |
|---|---|---|
| 3,627,929 | Gilissen et al | 12/14/71 |
| 3,976,850 | Faber et al | 08/24/76 |
| 4,087,151 | Robert et al | 05/02/78 |
| 4,106,841 | Vladic | 08/15/78 |
| 4,285,565 | Kirby | 08/25/81 |
| 4,514,030 | Triner et al | 04/30/85 |
| 4,647,100 | Crawford | 03/31,87 |
| 5,098,306 | Noschese et al | 03/24/92 |

| Other Patent No. | Issue Date |
|---|---|
| German 28 02 800 | 07/27/78 |
| UK 2 133 938 | 08/01/84 |
| PCT W085/04528 | 10/10/85 |

The known art utilizes opposing contacts which are usually bent or bowed members, parallel to one another which engage across the entire width of the respective contacts. Alternately a dimple has been used on a surface to obtain contact stress against the opposing contact.

It is important to have opposing contacts which can reliably and simply effect an electrical connection when the daughter board is removed from the mother board and which can overcome film deposits and debris on the surfaces of the contacts.

SUMMARY OF THE INVENTION

The present invention provides a reliable shorting circuit on the mother board by a high stress contact wherein the contacts are transverse to one another and wipe against one another before engaging at a final contact point.

In accordance with the teachings of the present invention, there is disclosed herein an electrical assembly, which includes a printed circuit board alternately inserted and withdrawn between a pair of shorting contacts. The shorting contacts confront each other and are laterally-reversed mirror images of each other. Means are formed on each of the shorting contacts to assure an initial point contact therebetween. After the initial point contact, the shorting contacts wipe against each other and come to engage each other at a final point contact. The path from the initial point contact to the final point contact constitutes a line between the respective shorting contacts.

In a preferred embodiment, the pair of shorting contacts for printed circuit board assembly includes a pair of contact strips, each of which has a longitudinal axis. A protrusion is formed on each of the contact strips. Each protrusion is substantially bisected frustum conical in shape. Each protrusion has a respective base and a respective top. Each protrusion is formed at an acute angle with respect to the longitudinal axis of the respective contact strip. The contact strips are in a side-by-side relationship so that their respective angled protrusions confront one another substantially in a transverse configuration. In this manner, the base of each protrusion is opposite the top of each confronting protrusion so that the respective sides of the confronting protrusions on the contact strips initially engage each other at an initial point contact. A very high stress concentration is provided therebetween. The contact strips thereafter wipe against each other and come to engage each other at a final point contact. The path from the initial point contact to the final point contact constitutes a line between the respective contact strips.

In another preferred embodiment, a radiused protrusion is formed on each of the contact strips. The radiused protrusion is formed at an acute angle with respect to the longitudinal axis of the respective contact strip. The contact strips are in a side-by-side relationship so that their respective angled radiused protrusions confront one another substantially in a transverse configuration. The respective contact strips are twisted so that the contact strips initially engage each other at an initial point contact, thereby providing a very high stress concentration therebetween. The contact strips thereafter wipe against each other and come to engage each other at a final point contact. The path from the initial point contact to the final point contact constitutes a line between the respective contact strips.

These and other objects of the present invention will become apparent from a reading of the following specification, taken in conjunction with the enclosed drawings.

DETAILED DESCRIPTION OF THE PREFERRED EMBODIMENTS

Figure 1:
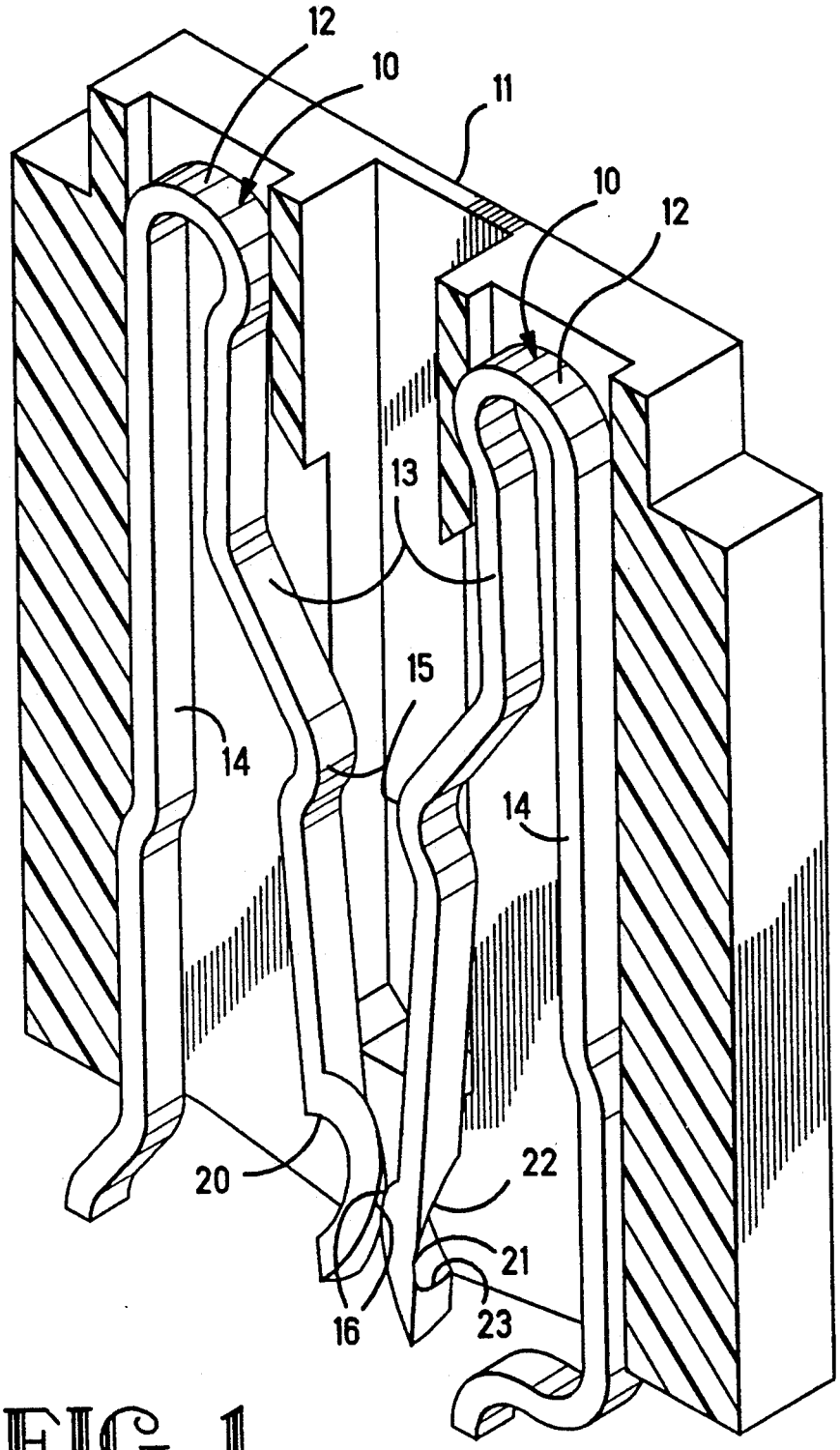
FIG. 1 is a perspective view of a mated pair of connector bodies showing the shorting contacts of the present invention.
Figure 2:
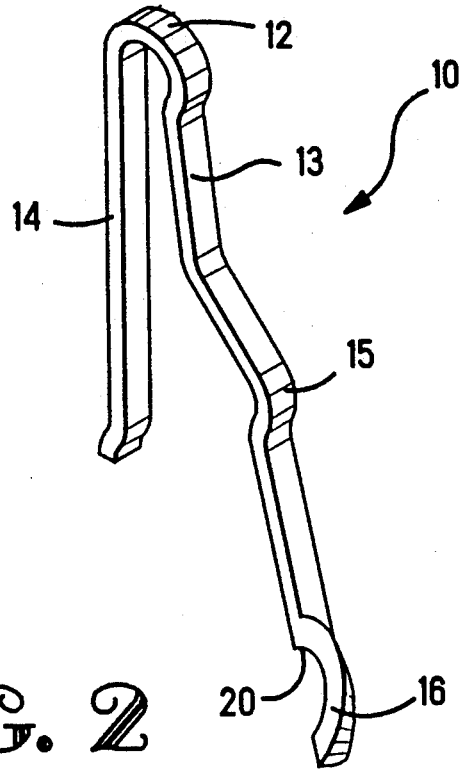
FIG. 2 is a perspective view or one connector body showing the right side of the shorting contact.
Figure 3:
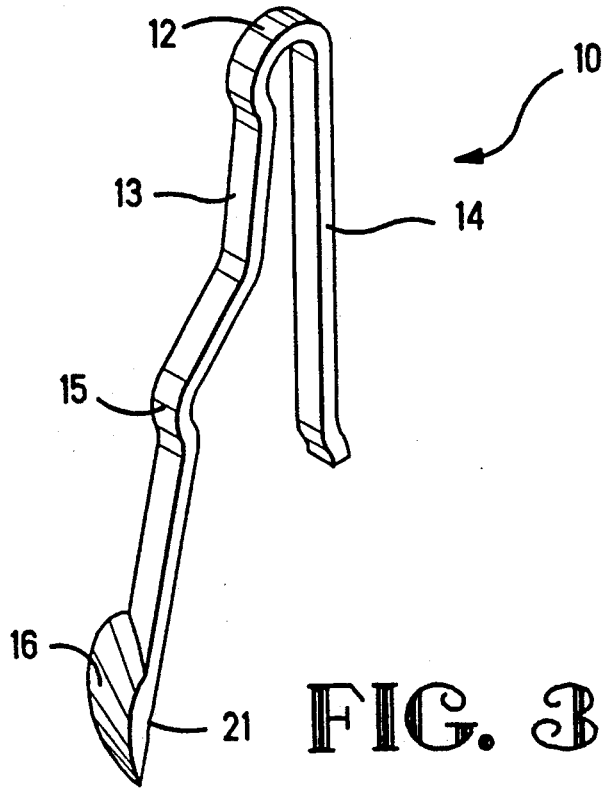
FIG. 3 is a perspective view of the connector body of FIG. 2 showing the left side of the shorting contact.
Figure 4:
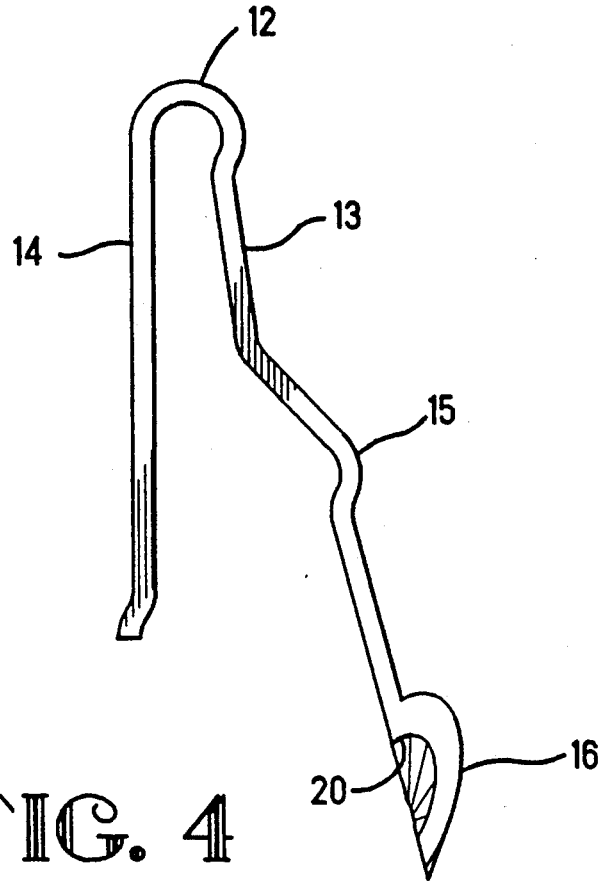
FIG. 4 is a side view of the connector body of FIG. 2.
Figure 5:
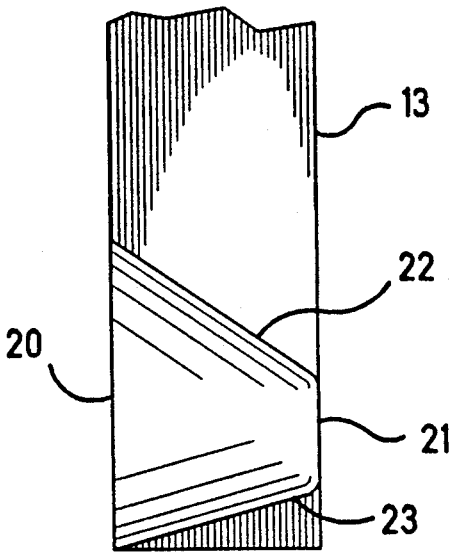
FIG. 5 is a partial front view of the connector body of FIG. 2 showing the shorting contact.
Figure 6A:
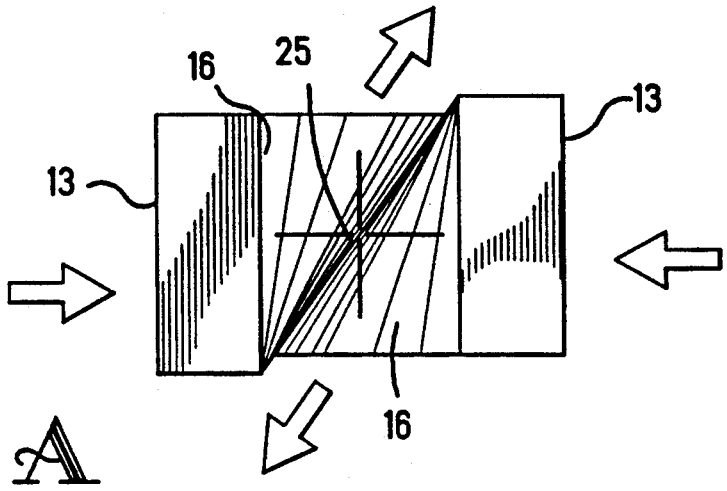
FIGS. 6A–6B are end views of the mated pair of connector bodies of FIG. 1 showing the wiping movement of shorting contacts.
Figure 6B:
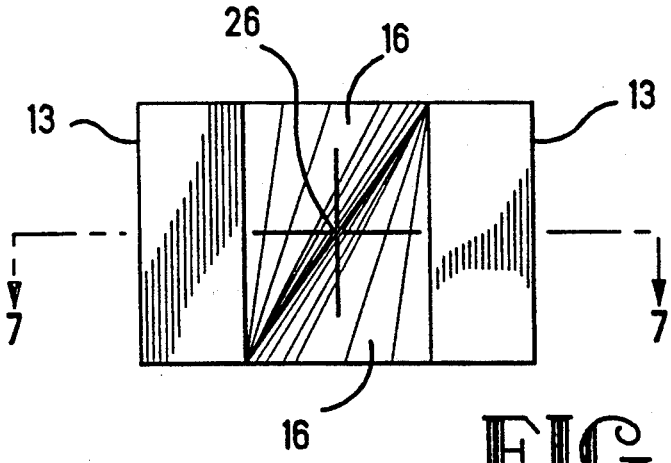
Figure 7:
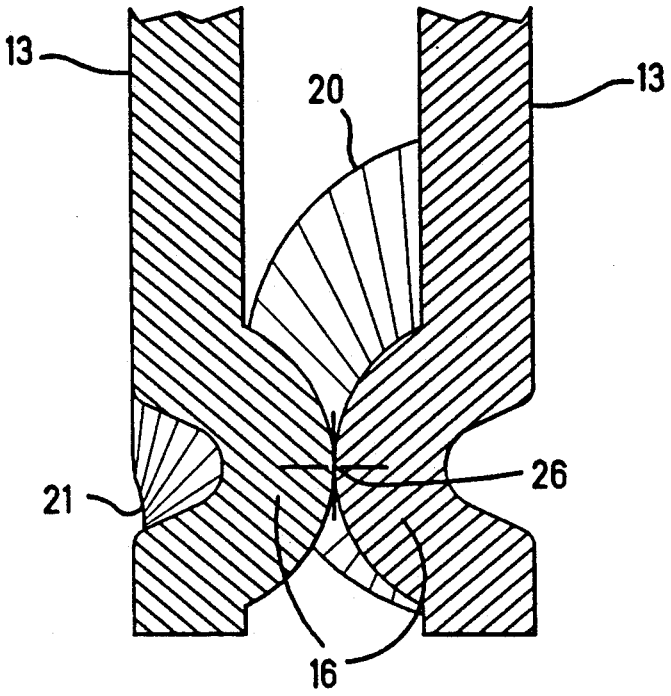
FIG. 7 is a cross section view taken across the lines 7—7 of FIG. 6B.
Figure 8B:
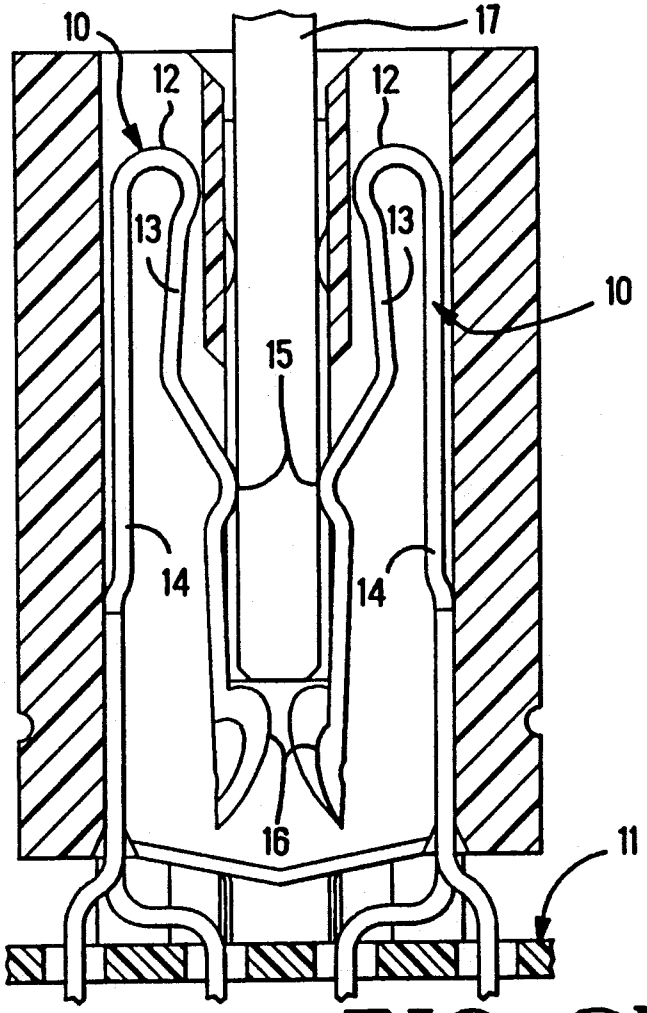
FIGS. 8A-8B are cross section views showing the insertion of a daughter beard between the mated connector bodies.
Figure 8A:
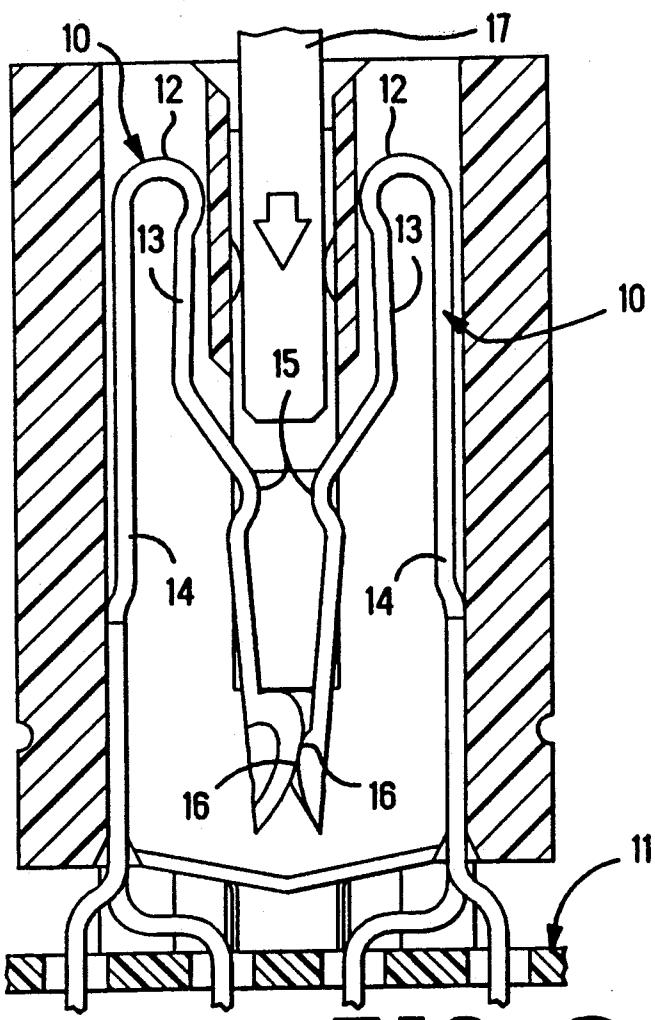

With reference to FIG. 1-8, a first embodiment of the present invention is shown. A plurality of connector bodies 10 are secured to a mother board 11. The connector body 10 is a strip of electrically conductive material (preferably beryllium copper) formed with a U-shaped bend 12 at the upper end, a front leg 13, a rear leg 14, an upper contact 15 at the approximate midpoint of the front leg 13 and a shorting contact 16 at the lower end of the front leg 13. The bent configuration of the connector body 10 provides a resiliency to the connector body 10 so that the shorting contact 16 is biased in a direction away from the rear leg 14.

Preferably the connector bodies 10 are secured in mating opposing pairs wherein the respective upper contacts 15 and shorting contacts 16 are facing the corresponding contacts on the opposing connector body 10. In the normal condition, the respective upper contacts 15 of the opposing connector bodies 13 are spaced apart and the respective shorting contacts 16 of the opposing connector bodies 10 are touching one another to provide an electrical connection (a shorting connection) between the mated connector bodies 10. A daughter board 17 having an electrical circuit thereon may be inserted between the mated connector bodies 10. The daughter board 17 initially makes electrical contact with the upper contacts 15 on the respective mating connector bodies 10. As the daughter board 17 is further inserted, the opposing shorting contacts 16 are separated. Upon removal of the daughter board 17 from between the mated connector bodies 10, the opposing shorting contacts 16 are urged together due to the resiliency of the respective connecting bodies 10 and a shorting type electrical connection is effected between the mated connecting bodies 10.

The present invention is directed toward the shorting contacts 16 to assure a high reliability electrical connection. The development of a film such as an oxide or the deposition of debris such as dust on the engaging surfaces of the respective shorting contacts 16 are common causes of poor electrical contact. The present invention overcomes these problems.

In one preferred embodiment, the shorting contact 16 is a protrusion 16 formed on the longitudinal axis of the contact strip. The protrusion 16 is in the shape of a bisected frustum cone having a base 20, a top 21, an upper side 22 and a lower side 23. The altitude of the protrusion 16 is between the base 20 and the top 21 and is also perpendicular to the longitudinal axis of the front leg 13. The upper side 22 is disposed at an angle of approximately 30°-60° with respect to the altitude of the protrusion 16 with a particularly preferred disposition of approximately 45°. The lower side 23 is disposed at an angle of approximately 0°-45° with respect to the altitude of the protrusion 16. In this manner, both sides 23, 24 of the protrusion 16 are disposed at an acute angle with respect to the longitudinal axis of the front leg 13.

The respective protrusions 16 on the mated connector bodies 10 are laterally-reversed mirror images of one another. In this manner, the base 20 of the protrusion 16 on one connector body 10 is disposed opposite the top 21 of the protrusion 16 on the mated connector body 10 and the respective protrusions 16 confront one another in a transverse configuration.

As the respective protrusions 16 initially contact one another there is an initial contact point 25 on the curved edge of each respective protrusion 16. Due to the resiliency of the connector bodies 10, and there being only a point contact between the connector bodies 10, the contact point 25 is under high stress. Also due to said resiliency and the arcuate nature of the contacting edges of the respective protrusions 16, the protrusions 16 wipe against one another in a sliding movement and come to engage one another at a final contact point 26, the path between the initial contact point 25 and the final contact point 26 constituting a line. When the mated connector boards 10 are viewed from the end and as the daughter board 17 is inserted between the connector boards 19, the shorting contacts move slightly sideways with respect to one another and then outwardly from one another in a letter "L" like movement.

Figure 9:
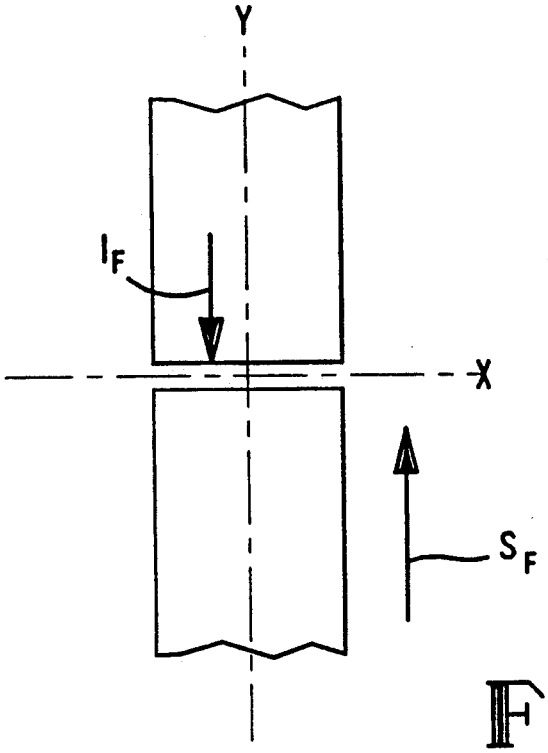
FIG. 9 is a sketch showing contacting edges being substantially parallel to one another and the forces attendant thereto.
Figure 10:
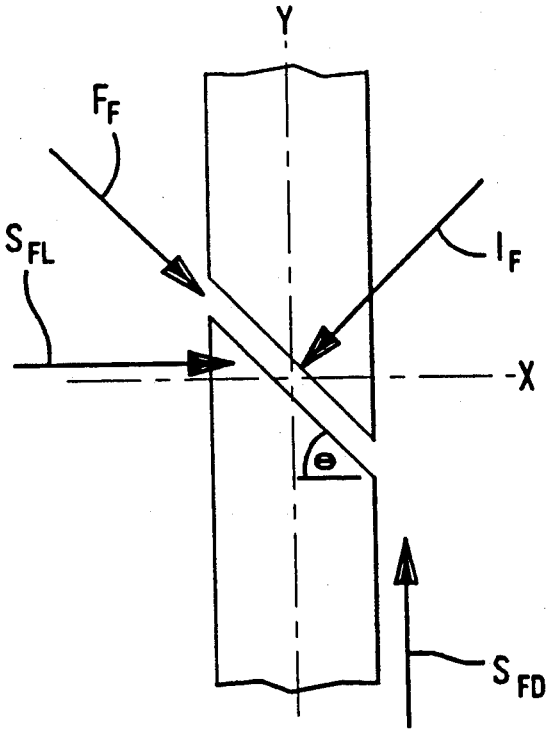
FIG. 10 is a sketch showing contacting edges meeting at an angle with the forces attendant thereto.

The advantage of having the contact surfaces at an angle with respect to one another is further shown in FIGS. 9 and 10. FIG. 9 shows the contacting edges being substantially parallel to one another as is common practice in the field. In this situation the spring force ($S_F$) is equal and opposite to the contact interface force. However, when the opposing contacts meet at an angle with respect to one another (FIG. 10) the interface force ($I_F$) is greater than the direct spring force ($S_{FD}$). To illustrate, $S_{FD}$ is spring force direct, $F_F$ is friction force, $S_{FL}$ is spring force lateral, $I_F$ is interface force.

Let $F_X$=any force component acting along X axis $F_Y$=any force component acting along Y axis Then, for system in static equilibrium: $\Sigma F_X=0$ and $\Sigma F_Y=0$ As a reasonable example assume:

spring force direct $S_{FD}=50$ grams interface angle $\Theta=45°$ coefficient of friction $\mu=0.2$

| | |
|---|---|
| Then | $\Sigma F_Y = S_{FD} - F_F \sin\Theta - I_F \cos\Theta = 0$ |
| Where | $F_F = \mu I_F$ |
| So | $S_{FD} - \mu I_F \sin\Theta - I_F \cos\Theta - 0$ |
| | $50 - .2\, I_F \sin 45° - I_F \cos 45° = 0$ |
| | $50 - .1414\, I_F - .707\, I_F = 0$ |
| | $50 - .8485\, I_F = 0$ |
| | $I_F = 58.9$ grams, this is higher than $S_{FD}$ |
| Also | $\Sigma F_X = 0$ |
| | $\Sigma F_X = S_{FL} + F_F \cos\Theta - I_F \sin\Theta = 0$ |
| | $S_{FL} + \mu I_F \cos\Theta - I_F \sin\Theta = 0$ |
| | $S_{FL} + .2\,(58.9) \cos 45 - 58.9 \sin 45 = 0$ |
| | $S_{FL} + 8.3 - 41.6 = 0$ |

-continued

| |
|---|
| $S_{FL}$ = 33.3 grams |

As shown, the interface force is greater than the spring force. This can be viewed as a wedge effect. An increase in the force at the interface further increases the surface stress.

Thus, the wiping movement between the respective protrusions consists of a moving point of contact which effectively overcomes any film or debris on the respective shorting contacts 16 and provides a highly reliable electrical contact.

Figure 11:
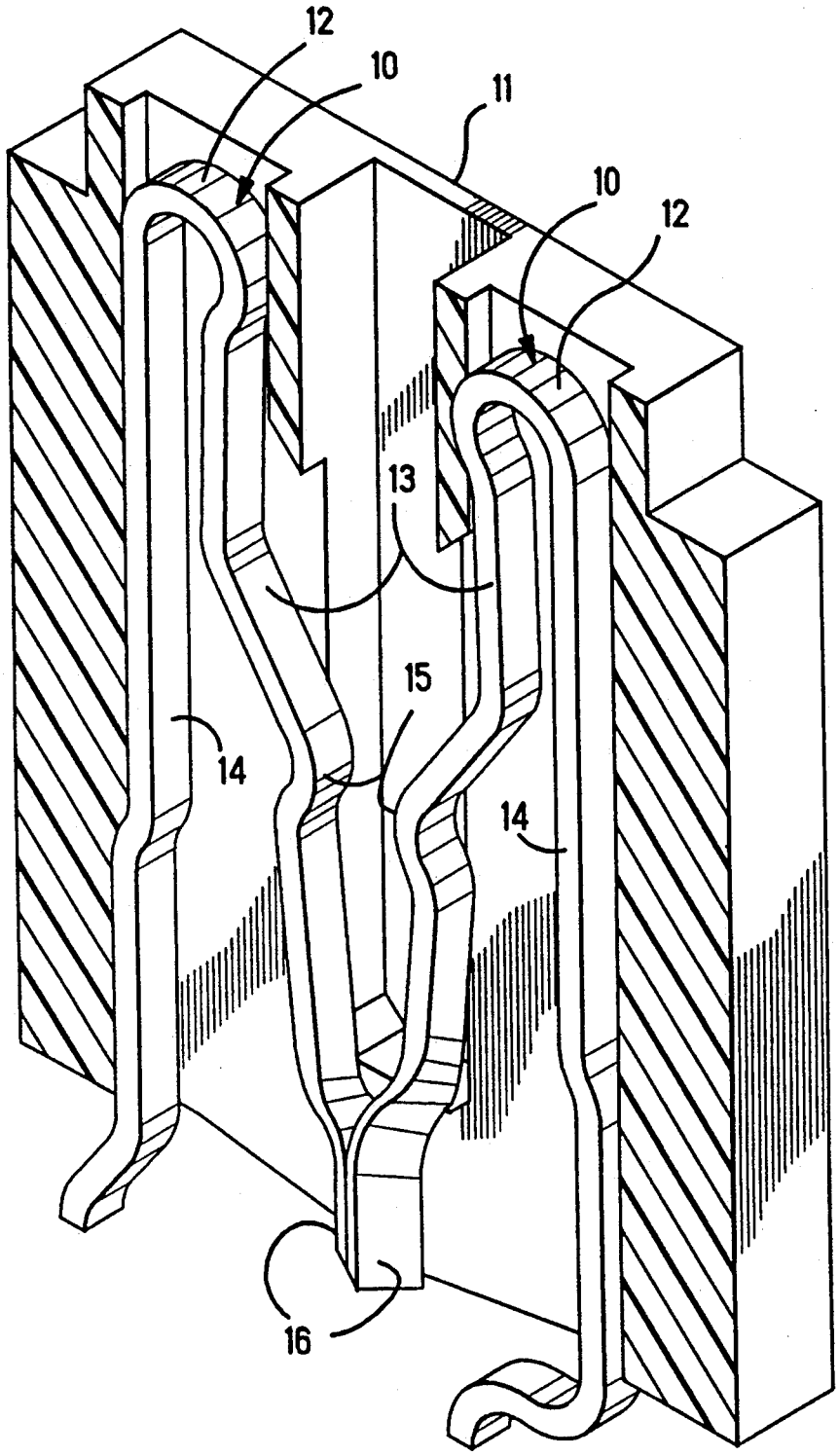
FIG. 11 is a perspective view of a mated pair of connector bodies showing the shorting contacts of another embodiment of the present invention.
Figure 12A:
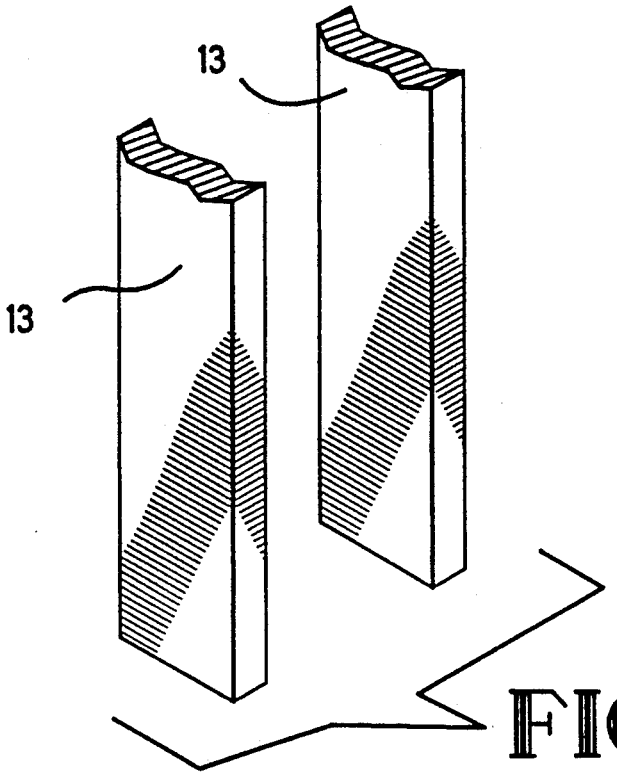
FIGS. 12A-12D are perspective views of the embodiment of FIG. 11 showing the forming of the shorting contacts.
Figure 12B:
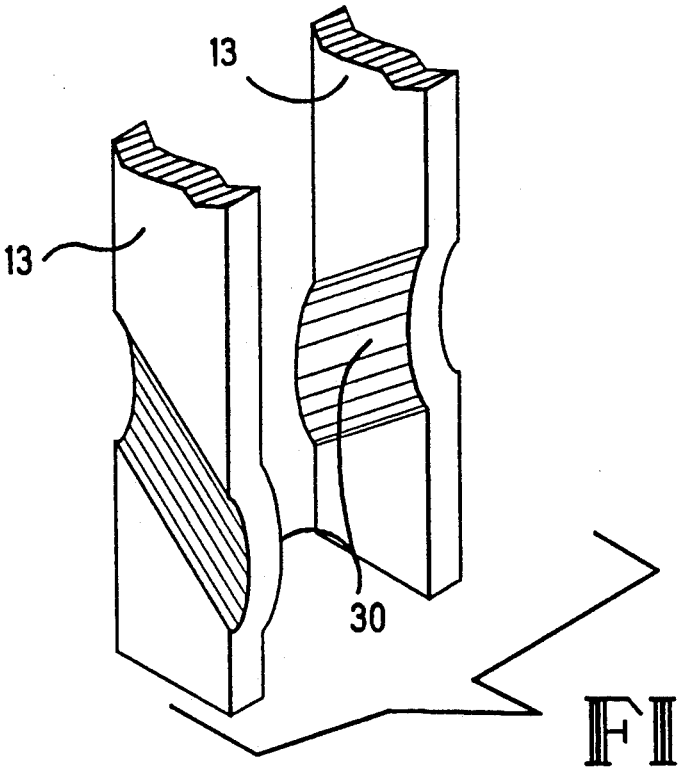
Figure 12C:
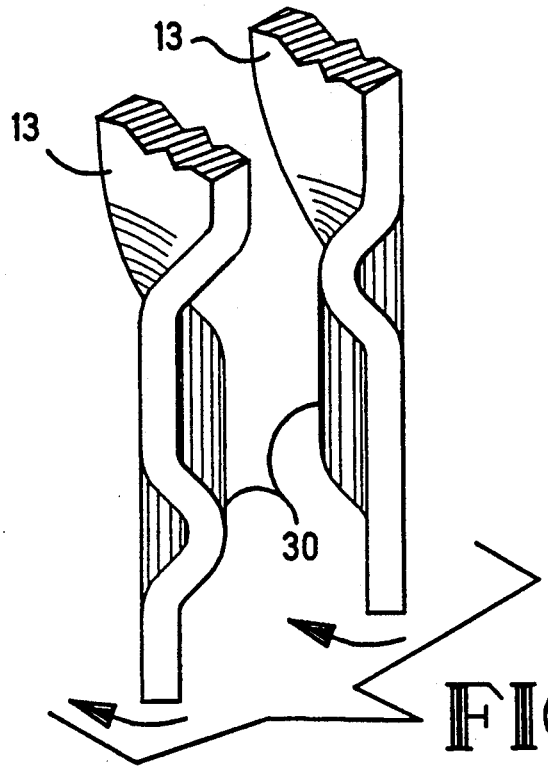
Figure 12D:
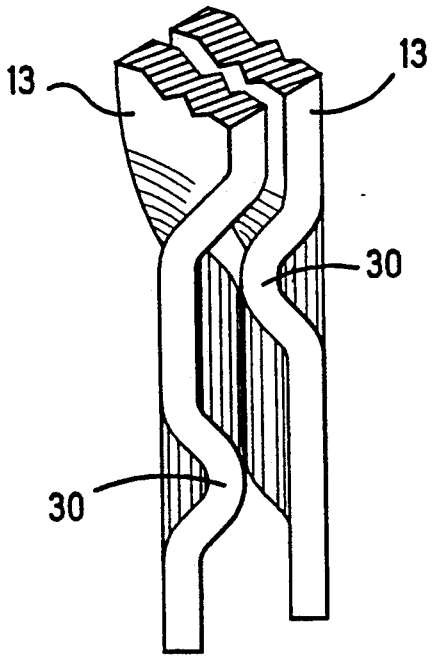
Figure 13A:
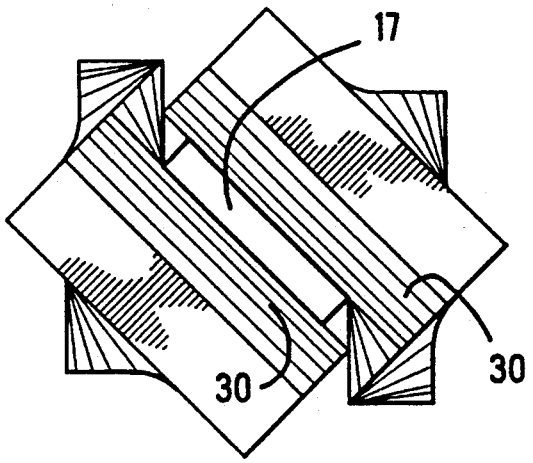
FIG. 13A-13C are end views of the embodiment of FIG. 11 showing the wiping movement of the shorting contacts.
Figure 13B:
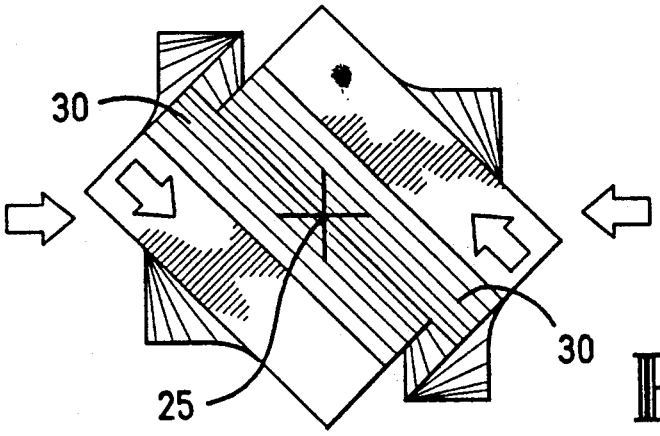
Figure 13C:
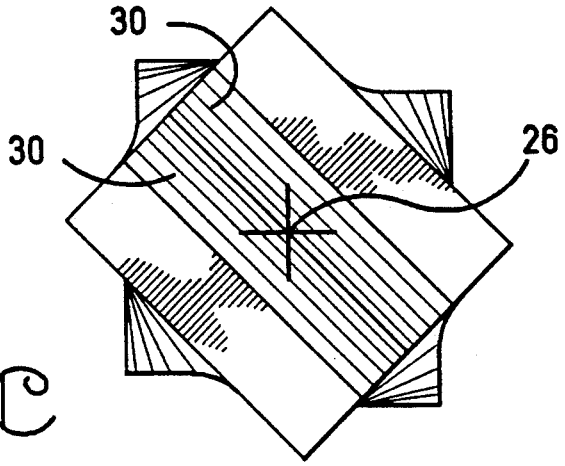

In another preferred embodiment (FIGS. 11-13) the shorting contacts 16 on the respective connecting bodies 10 are formed as a radiused protrusion 30 which is at an acute angle with respect to the longitudinal axis of the front leg 13 of the respective connecting body 10. The method of forming the radiused protrusion 30 is shown in FIGS. 12A-12D. The radiused protrusion 30 is formed in the connecting body at approximately 30°-60° with respect to longitudinal axis and at an especially preferred angle of 45°. The mated opposed connector body 10 also has a radiused protrusion 30 formed therein, the radiused protrusion being a laterally-reversed mirror image of the opposite and confronting radiused protrusion. In the preferred configuration, where the respective radiused protrusions 30, 30 are disposed at an angle of 45° with respect to the longitudinal axis of the front leg, the radiused protrusions on the mated connecting bodies 10 are at 90° with respect to one another. In order to further improve the reliability of the connection, the respective front legs 13 of the connecting bodies are twisted through approximately 45° so that when the radiused protrusions 30, 30 on the respective bodies 10 contact one another, the angle of the contact is approximately 45°. When the opposing radiused protrusions 30, 30 initially engage one another, there is an initial contact point on the curved edge of each respective protrusion 30. As in the previously described embodiment, the contact point is under high stress and due to the resiliency of the connecting bodies and the arcuate nature of the contacting edges, the protrusions wipe past one another in a sliding moving until the resilient forces equalize and the motion stops at a final contact point. The path between the initial contact point and the final contact point constitutes a line.

As will be appreciated by those skilled in the art, the present invention provides features and advantages as follows: (1) contact between opposing shorting contacts is reliable, (2) point contact is made under high stress and (3) a wiping movement between the opposing shorting contacts overcomes film and debris on the contact surfaces.

Obviously, many modifications may be made without departing from the basic spirit of the present invention. Accordingly, it will be appreciated by those skilled in the art that within the scope of the appended claims, the invention may be practical other than has been specifically described herein.

What is claimed is:

1. In an electrical assembly, the combination of a printed circuit board alternately inserted and withdrawn between a pair of shorting contacts, the shorting contacts confronting each other and being laterally-reversed mirror images of each other, and means formed on each of the shorting contacts to assure an initial point contact therebetween;

such that after the initial point contact, the shorting contacts wipe against each other and come to engage each other at a final point contact; and such that the path from the initial point contact to the final point contact constitutes a line between the respective shorting contacts.

2. A pair of shorting contacts for a printed circuit board assembly, comprising a pair of contact strips, each of which has a longitudinal axis, a protrusion on each of the contact strips, each protrusion being substantially bisected frustum conical in shape, each protrusion having a respective base and a respective top, each protrusion being formed at an acute angle with respect to the longitudinal axis of the respective contact strip, the contact strips being in a side-by-side relationship so that their respective angled protrusions confront one another substantially in a transverse configuration, wherein the base of each protrusion is opposite the top of each confronting protrusion so that the respective sides of the confronting protrusion on the contact strips initially engage each other at an initial point contact, thereby providing a very high stress concentration therebetween, and so that the contact strips thereafter wipe against each other and come to engage each other at a final point contact, and such that the path from the initial point contact to the final point contact constitutes a line between the respective contact strips.

3. The shorting contacts of claim 2, wherein the acute angle is in the range of 30° to 60°.

4. The shorting contacts of claim 3, wherein the acute angle is approximately 45°.

5. The shorting contacts of claim 2, further comprising each protrusion having a respective side and a respective altitude between the base and the top, wherein an angle is formed on each protrusion between the respective side and the respective base, the angle being the same on each protrusion, the angle being in the range of 30° to 60°.

6. A pair of shorting contacts for a printed circuit board assembly, comprising a pair of contact strips, each of which has a longitudinal axis, a radiused protrusion on each of the contact strips, the radiused protrusion being formed at an acute angle with respect to the longitudinal axis of the respective contact strip, the contact strips being in a side-by-side relationship so that their respective angled radiused protrusions confront one another substantially in a transverse configuration, and the respective contact strips being twisted so that the contact strips initially engage each other at an initial point contact, thereby providing a very high stress concentration therebetween, and so that the contact strips thereafter wipe against each other and come to engage each other at a final point contact, and such that the path from the initial point contact to the final point contact constitutes a line between there respective contact strips.

7. The shorting contacts of claim 6, wherein the acute angle is in the range of 30° to 60°.

8. The shorting contacts of claim 7, wherein the acute angle is approximately 45°.

9. The method of forming a pair of shorting contacts for a printed circuit board assembly, comprising the steps of providing a pair of contact strips, each of which has a longitudinal axis, forming a radiused protrusion on each of the contact strips, the radiused protrusion being formed at an acute angle with respect to the longitudinal axis of the respective contact strip, arranging the contact strips in a side-by-side relationship so that their respective angled radiused protrusions confront one another substantially in a transverse configuration, and twisting the respective contact strips so that the contact strips initially engage each other at an initial point contact, thereby providing a very high stress concentration therebetween, and so that the contact strips thereafter wipe against each other and come to engage each other at a final point contact, and such that the path from the initial point contact to the final point contact constitutes a line between the respective contact strips.

10. The method of claim 9, wherein the acute angle is in the range of 30° to 60°.

11. The method of clam 10, wherein the acute angle is approximately 45°.

* * * * *